US011815241B2

(12) United States Patent
Fischer et al.

(10) Patent No.: US 11,815,241 B2
(45) Date of Patent: Nov. 14, 2023

(54) HEADLIGHT FOR A VEHICLE INCLUDING A LIGHTING DEVICE HAVING A COLLIMATION OPTICAL SYSTEM WITH DIAPHRAGM AND PROJECTION OPTICAL SYSTEM

(71) Applicant: HELLA GmbH & Co. KGaA, Lippstadt (DE)

(72) Inventors: Bernd Fischer, Altenbeken (DE); Benjamin Willeke, Paderborn (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/877,312

(22) Filed: Jul. 29, 2022

(65) Prior Publication Data

US 2022/0364702 A1 Nov. 17, 2022

Related U.S. Application Data

(63) Continuation of application No. PCT/EP2021/050949, filed on Jan. 18, 2021.

(30) Foreign Application Priority Data

Jan. 30, 2020 (DE) ..... 10 2020 102 226.3

(51) Int. Cl.
*F21S 41/265* (2018.01)
*F21S 41/143* (2018.01)
*F21S 41/40* (2018.01)

(52) U.S. Cl.
CPC ..... *F21S 41/265* (2018.01); *F21S 41/143* (2018.01); *F21S 41/40* (2018.01)

(58) Field of Classification Search
CPC ..... F21S 41/265
See application file for complete search history.

(56) References Cited

U.S. PATENT DOCUMENTS 10,295,137 B2 5/2019 Stefanov et al.
10,465,874 B2 11/2019 Kamau et al.
(Continued)

FOREIGN PATENT DOCUMENTS

DE 102004035761 A1 3/2005
DE 102018107213 A1 10/2019
(Continued)

OTHER PUBLICATIONS

International Search Report dated Mar. 31, 2021 in corresponding application PCT/EP2021/050949.

*Primary Examiner* — Robert J May
(74) *Attorney, Agent, or Firm* — Muncy, Geissler, Olds & Lowe, P.C.

(57) ABSTRACT

A lighting device for a vehicle, in particular a headlight, including a light source, from which light emerges in operation of the lighting device, a collimation optical system having an incident face and an emergent face, which the light emerging from the light source passes through, a projection optical system having a first array of lenses and a second array of lenses, wherein the light emerging from the collimation optical system first passes through the first array of lenses and after that through the second array of lenses, as well as a diaphragm, which the light passes through, wherein the diaphragm is arranged in front of the first array of lenses, so that in operation of the lighting device the light does not strike the first array of lenses until after passing through the diaphragm.

13 Claims, 3 Drawing Sheets

(56) References Cited

U.S. PATENT DOCUMENTS

| | | | | |
|---|---|---|---|---|
| 10,563,836 | B2 | 2/2020 | Fischer et al. | |
| 10,612,741 | B2 | 4/2020 | Moser et al. | |
| 11,060,684 | B2 | 7/2021 | Moser | |
| 2005/0018443 | A1 | 1/2005 | Tsukamoto | |
| 2019/0301696 | A1* | 10/2019 | Fischer ..... | F21S 41/285 |

FOREIGN PATENT DOCUMENTS

| | | | |
|---|---|---|---|
| EP | 3312501 | A1 | 4/2018 |
| EP | 3404313 | A1 | 11/2018 |
| WO | WO2017066818 | A1 | 4/2017 |
| WO | WO2019060935 | A1 | 4/2019 |

* cited by examiner

HEADLIGHT FOR A VEHICLE INCLUDING A LIGHTING DEVICE HAVING A COLLIMATION OPTICAL SYSTEM WITH DIAPHRAGM AND PROJECTION OPTICAL SYSTEM

This nonprovisional application is a continuation of International Application No. PCT/EP2021/050949, which was filed on Jan. 18, 2021, and which claims priority to German Patent Application No. 10 2020 102 226.3, which was filed in Germany on Jan. 30, 2020, and which are both herein incorporated by reference.

BACKGROUND OF THE INVENTION

Field of the Invention

The present invention relates to a lighting device for a vehicle, in particular a headlight.

Description of the Background Art

A lighting device is known from WO 2017/066818 A1, which corresponds to US 2019/0072252. The lighting device described therein is designed as a headlight and includes a light source that is composed of light-emitting diodes and from which light emerges in operation of the lighting device. The lighting device additionally includes a collimation optical system, which the light emerging from the light source passes through. The lighting device additionally includes a projection optical system, which the light emerging from the collimation optical system passes through. In this design the projection optical system has a substrate with an array of lenses on an incident face facing the collimation optical systems and with an array of lenses on an opposite emergent face. In addition, two arrays of diaphragms are provided between the two arrays of lenses, wherein two diaphragms of the arrays of diaphragms are associated with each of the lenses of the first and second arrays, which diaphragms the light emerging from the individual lenses of the first array passes through sequentially. The arrays of diaphragms can be applied to the substrates, which serve as carriers for the arrays of lenses, by means of complicated vapor deposition processes and subsequent laser beam induced material removal. It must be considered a disadvantage of this lighting device known from the prior art that manufacture is relatively labor-intensive.

Another lighting device for a vehicle is known from DE 10 2018 107 213 A1, which corresponds to US 2019/0301696, which is incorporated herein by reference. The lighting device described therein is designed as a headlight and includes three light sources designed as light-emitting diodes (LED), from which light emerges in operation of the lighting device. The lighting device additionally includes three collimation optical systems, wherein one of the collimation optical systems is associated with each one of the light sources so that the light emerging from one of the light sources passes through the associated collimation optical system. In this design each of the collimation optical systems has an incident face facing the associated light source and an emergent face opposite thereto. A diaphragm is arranged on the incident face of each one of the collimation optical systems. The lighting device additionally includes a projection optical system, which the light emerging from the collimation optical systems passes through. In this design the projection optical system has a substrate with an array of cylindrical lenses on an incident face facing the collimation optical systems and with an array of prisms on an opposite emergent face. In this design, each one of the collimation optical systems projects the image plane located at its incident face and defined by the diaphragm into the space outside the vehicle at infinity. The cylindrical lenses have vertically oriented cylinder axes so that the array of cylindrical lenses causes a horizontal spreading of the light distribution. The prisms deflect the light in the vertical direction so that the prisms, together with the collimation optical systems and the arrangement of the light-emitting diodes, achieve the desired illumination in the vertical direction. It must be considered a disadvantage of this lighting device known from the prior art that a low beam geometry designed as a wedge located in the image plane, for example, is likewise spread by the cylindrical lenses and thus appears blurred.

SUMMARY OF THE INVENTION

It is therefore an object of the present invention to provide a lighting device of with which a desired light distribution in the space outside the vehicle can be realized with simple means.

According to an exemplary embodiment, provision is made that the diaphragm is arranged in front of the first array of lenses, so that in operation of the lighting device the light does not strike the first array of lenses until after passing through the diaphragm. In this way, because the diaphragm no longer must be arranged in the form of an array between the two arrays of lenses, substantially simpler manufacture of the lighting device results. The diaphragm can also be designed substantially more simply than in the prior art according to WO 2017/066818 A1. In contrast to the arrays of diaphragms described therein, a simple rectangular aperture can be used.

Provision can be made here that the diaphragm can be arranged at the collimation optical system. For example, the diaphragm can be arranged on the incident face of the collimation optical system, in particular be vapor-deposited on the incident face. The arrangement of the diaphragm at the collimation optical system results in positioning of the diaphragm that is easy to implement.

The possibility exists that the first array of lenses generates a multiplicity of intermediate images of the diaphragm in the space between the two arrays of lenses, in particular wherein the second array of lenses can project the intermediate images into the space outside the vehicle, in particular at infinity, when the lighting device is in the installed state in the vehicle. As a result, the light distribution in the space outside the vehicle can be controlled in a targeted manner by the second array of lenses.

Provision can be made that the two arrays of lenses are formed on a substrate, wherein the first array of lenses is arranged on the incident face and the second array of lenses on the emergent face of the substrate. As a result, a very compact and robust construction of the lighting device is produced. For example, the substrate with the arrays arranged thereon can be designed as a one-piece, injection-molded part.

The possibility exists that the lenses of at least one of the two arrays, in particular the lenses of both arrays, are designed as cylindrical lenses. In this case the cylindrical lenses can be arranged adjacent to one another in the horizontal direction and the cylinder axes of the cylindrical lenses can extend in the vertical direction when the lighting device is in the installed state in the vehicle. Consequently, the illumination in the space outside the vehicle in the horizontal direction can be controlled in a targeted manner by the cylindrical lenses.

The possibility alternatively exists that the lenses of at least one of the two arrays, in particular the lenses of both arrays, are designed as lenses that have a refractive power in two directions perpendicular to one another and to the central direction of propagation of the light. For example, the lenses can be spherical in design. Lenses of such a design can control the illumination in the space outside the vehicle in the horizontal and vertical directions in a targeted manner.

Provision can be made that at least two, in particular all, lenses of the second array have radii of curvature that differ from one another or focal lengths that differ from one another. This can achieve the result, in particular, that the images of the intermediate images are enlarged in the lower end region of the light distribution generated in the space outside the vehicle, so that a connection to a vicinity lighting generated in front of the vehicle is produced.

The possibility exists that the light source includes at least one light-emitting diode and/or at least one laser diode.

Provision can be made that the lighting device includes a multiplicity of light sources as well as a multiplicity of collimation optical systems and a projection optical system or a multiplicity of projection optical systems, which are each arranged adjacent to one another in the horizontal direction when the lighting device is in the installed state in the vehicle. In this design, a collimation optical system and the projection optical system or one of the projection optical systems can be associated with one of the light sources in each case in such a manner that the light emerging from the light source passes through the associated collimation optical system and the projection optical system or the associated projection optical system sequentially. The intensity and width of the light distribution can be increased through the choice of a multiplicity of light sources and collimation optical systems arranged adjacent to one another in the horizontal direction.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
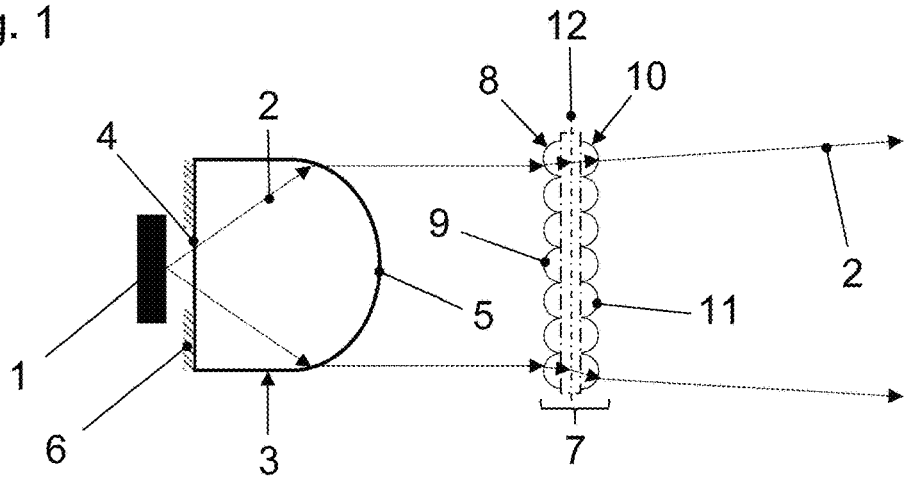
FIG. 1 is a top view of a first embodiment of a lighting device according to the invention.
Figure 2:
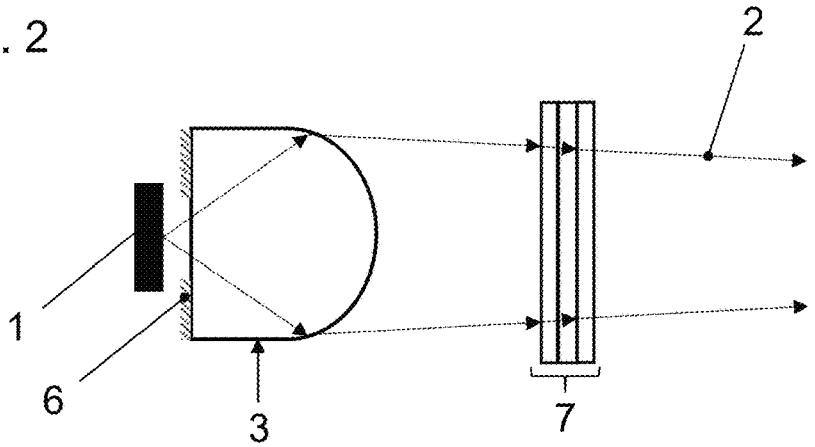
FIG. 2 is a side view of the lighting device according to FIG. 1.

The embodiment of a lighting device according to the invention depicted in FIG. 1 and FIG. 2 includes a light source 1, represented only schematically, from which light 2 emerges. The light source 1 can have at least one light-emitting diode and/or at least one laser diode.

The lighting device additionally includes a collimation optical system 3 having an incident face 4 and an emergent face 5, which the light 2 emerging from the light source 1 passes through sequentially. The lighting device additionally includes a diaphragm 6, which is arranged on the incident face 4 of the collimation optical system 3. The diaphragm 6 can be vapor-deposited on the incident face 4. The diaphragm 6 can have a rectangular aperture whose lower edge can define a cutoff line in the light distribution generated in the space outside the vehicle.

The lighting device additionally includes a projection optical system 7, which includes a first array 8 of lenses 9 and a second array 10 of lenses 11. In this design, the light emerging from the collimation optical system 3 passes first through the first array 8 of lenses 9 and after that through the second array 10 of lenses 11.

The lenses 9, 11 of the first and second arrays 8, 10 are each designed as cylindrical lenses. The cylindrical lenses are arranged adjacent to one another in the horizontal direction when the lighting device is in the installed state in the vehicle, wherein the cylinder axes of the cylindrical lenses extend in the vertical direction. The lenses 9, 11 of the first and second arrays 8, 10 thus only affect the horizontal direction.

The first array 8 of lenses 9 generates a multiplicity of intermediate images of the diaphragm 6 in an image plane 12 in the space between the two arrays 8, 10. The second array 10 of lenses 11 projects the intermediate images into the space outside the vehicle at infinity when the lighting device is in the installed state in the vehicle. Consequently, the illumination in the space outside the vehicle can be controlled in the horizontal direction in a targeted manner by the cylindrical lenses. The distribution in the vertical direction is determined by the divergence of the light source 1, the diaphragm 6, and the collimation optical system 3.

Figure 3:
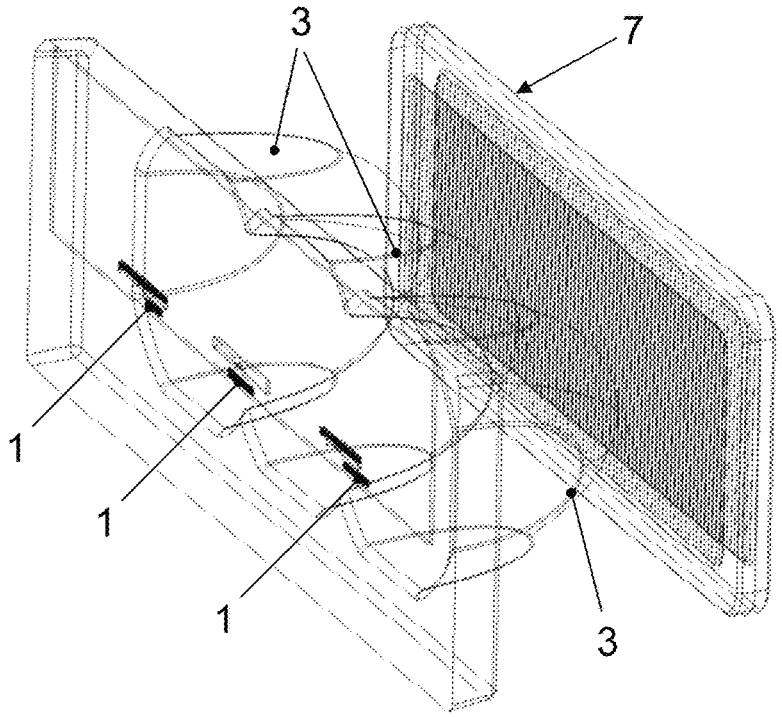
FIG. 3 is a perspective view of a second embodiment of a lighting device according to the invention.

FIG. 3 shows an embodiment in which three light sources 1 as well as three collimation optical systems 3 and a projection optical system 7 are provided, wherein the light sources 1 and the collimation optical systems 3 are each arranged adjacent to one another in the horizontal direction when the lighting device is in the installed state in the vehicle. In this design, a collimation optical system is associated with each one of the light sources 1 in such a manner that the light 2 emerging from the light source 1 passes through the associated collimation optical system and then through the projection optical system 7. Here, the lenses 9, 11 of the first and second arrays 8, 10 of the projection optical system 7 are designed as cylindrical lenses whose cylinder axes extend in the vertical direction, as in the first embodiment according to FIG. 1 and FIG. 2.

Instead of one common projection optical system 7 for all of the light sources 1 and collimation optical systems 3, it is also possible for three projection optical systems 7 to be provided that are associated in each case with the individual light sources 1 and collimation optical systems 3.

Figure 4:
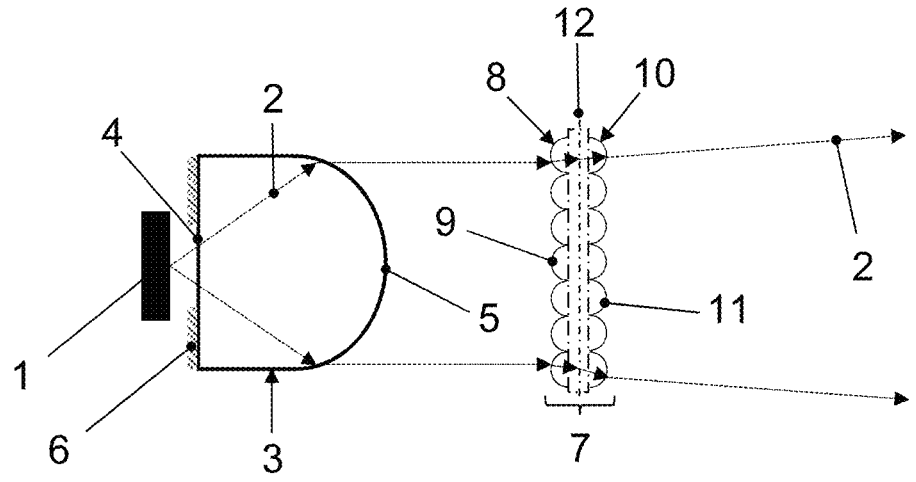
FIG. 4 is a top view of a third embodiment of a lighting device according to the invention.
Figure 5:
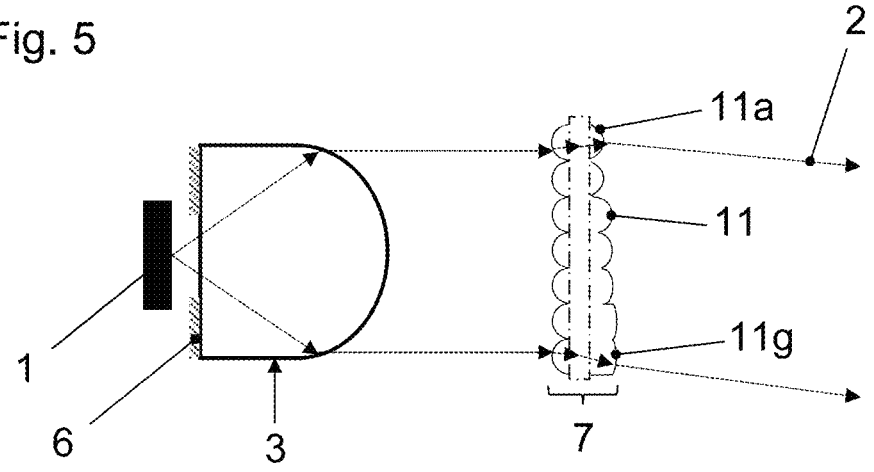
FIG. 5 is a side view of the lighting device according to FIG. 4.

The third embodiment depicted in FIG. 4 and FIG. 5 corresponds largely to the first embodiment depicted in FIG.

1 and FIG. 2. In contrast thereto, the lenses 9, 11 of the arrays 8, 10 in the embodiment according to FIG. 4 and FIG. 5 are not designed as cylindrical lenses, but instead as lenses 9, 11 that have a refractive power in both the horizontal direction and the vertical direction. For example, the lenses 9, 11 are spherical lenses. As a result, the lenses 11 of the second array 10, in particular, can control the illumination in the space outside the vehicle in the horizontal and vertical directions in a targeted manner.

In the embodiment according to FIG. 4 and FIG. 5, at least two, in particular all, lenses 11 of the second array 10 have radii of curvature that differ from one another or focal lengths that differ from one another. In this design the radius of curvature, and thus the focal length, of the lenses 11 located further toward the bottom in FIG. 5 is larger than the radius of curvature, and thus the focal length, of the lenses 11 located further toward the top in FIG. 5. For example, the radius of curvature of the topmost lens 11*a* in FIG. 5 is significantly smaller than the radius of curvature of the bottommost lens 11*g* in FIG. 5.

Figure 6:
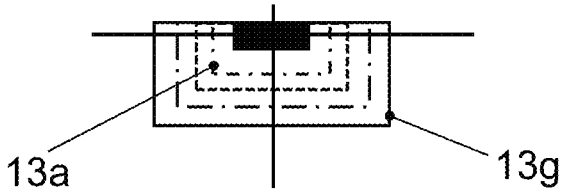
FIG. 6 is a schematic illustration of images of different sizes from differently shaped lenses.

FIG. 6 schematically illustrates that different-sized images of the light 2 striking the lenses 11 or of the intermediate images generated in the plane 12 are generated by different radii of curvature. For example, a small image, such as the image labeled 13*a* in FIG. 6, could be generated by a lens with a small radius of curvature such as the lens 11*a*. Moreover, a large image, such as the image labeled 13*g* in FIG. 6, could be generated by a lens with a large radius of curvature such as the lens 11*g*.

By this means, the result can be achieved, in particular, that the images 13*a*, 13*g* of the intermediate images are enlarged in the lower end region of the light distribution generated in the space outside the vehicle, so that a connection to a vicinity lighting generated in front of the vehicle is produced.

Figure 7:
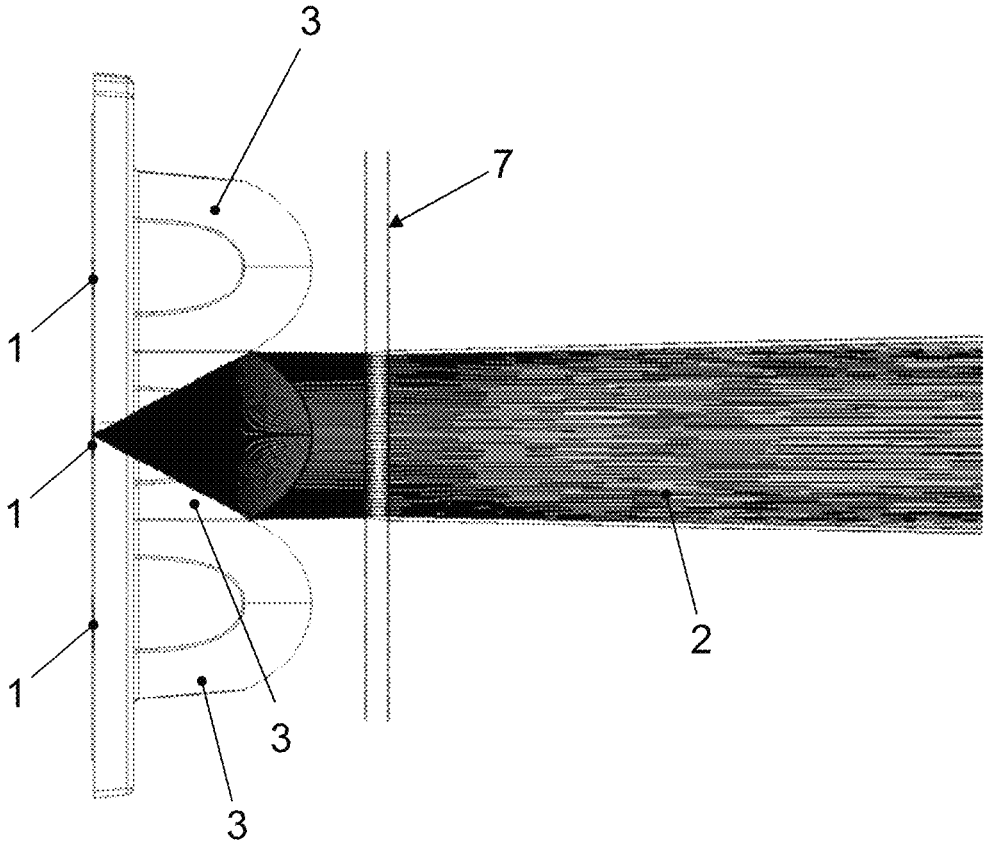
FIG. 7 is a top view of a fourth embodiment of a lighting device according to the invention.

FIG. 7 shows the beam path of the light 2 through an embodiment in which three light sources 1 as well as three collimation optical systems 3 and a projection optical system 7 are provided, wherein the light sources 1 and the collimation optical systems 3 are each arranged adjacent to one another in the horizontal direction when the lighting device is in the installed state in the vehicle. In this design, a collimation optical system is associated with each one of the light sources 1 in such a manner that the light 2 emerging from the light source 1 passes through the associated collimation optical system and then through the projection optical system 7. Here, the lenses 9, 11 of the first and second arrays 8, 10 of the projection optical system 7 are designed as lenses 9, 11 that have a refractive power in both the horizontal direction and the vertical direction, as in the third embodiment according to FIG. 4 and FIG. 5.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A lighting device for a vehicle, the lighting device comprising:

a light source from which light emerges in operation of the lighting device;

a collimation optical system having an incident face and an emergent face, which the light emerging from the light source passes through;

a projection optical system having a first array of lenses and a second array of lenses, wherein the light emerging from the collimation optical system first passes through the first array of lenses and after that passes through the second array of lenses; and a diaphragm, which the light passes through, wherein the diaphragm is arranged in front of the first array of lenses so that in operation of the lighting device, the light does not strike the first array of lenses until after passing through the diaphragm, wherein the lenses of at least one of the first or second arrays or the lenses of both of the first and second arrays are cylindrical lenses, and wherein the cylindrical lenses are arranged adjacent to one another in the horizontal direction and cylinder axes of the cylindrical lenses extend in the vertical direction when the lighting device is in an installed state in the vehicle.

2. The lighting device according to claim 1, wherein the diaphragm is arranged at the collimation optical system.

3. The lighting device according to claim 2, wherein the diaphragm is arranged on the incident face of the collimation optical system or is vapor-deposited on the incident face.

4. The lighting device according. to claim 2, wherein the first array of lenses generates a multiplicity of intermediate images of the diaphragm in space between the first and second arrays of lenses.

5. The lighting device according to claim 4, wherein the second array of lenses projects the intermediate images into a space outside the vehicle when the lighting device is in the installed state in the vehicle.

6. The lighting device according to claim 4, wherein the second array of lenses projects the intermediate images at infinity outside the vehicle.

7. The lighting device according to claim 1, wherein the first and second arrays of lenses are formed on a substrate, wherein the first array of lenses is arranged on an incident face of the substrate and the second array of lenses is arranged on an emergent face of the substrate.

8. The lighting device according to claim 1, wherein the light source includes at least one light-emitting diode and/or at least one laser diode.

9. The lighting device according to claim 1, wherein the lighting device includes at least two light sources as well as at least two collimation optical systems and the projection optical system or at least two projection optical systems, which are each arranged adjacent to one another in the horizontal direction when the lighting device is in an installed state in the vehicle.

10. The lighting device according to claim 9, wherein each collimation optical system and the projection optical system or one of the projection optical systems are associated with each one of the light sources in such a manner that the light emerging from the light source passes through the associated collimation optical system and the projection optical system or the associated projection optical system sequentially.

11. The lighting device according to claim 1, wherein the lighting device is for a headlight of the vehicle.

12. A lighting device for a vehicle, the lighting device comprising:

a light source from which light emerges in operation of the lighting device;

a collimation optical system having an incident face and an emergent face, which the light emerging from the light source passes through;

a projection optical system having a first array of lenses and a second array of lenses, wherein the light emerging from the collimation optical system first passes through the first array of lenses and after that passes through the second array of lenses; and a diaphragm, which the light passes through, wherein the diaphragm is arranged in front of the first array of lenses so that in operation of the lighting device, the light does not strike the first array of lenses until after passing through the diaphragm, wherein the lenses of at least one of the first or second arrays or the lenses of both of the first and second arrays are lenses that have a refractive power in two directions substantially perpendicular to one another and to a central direction of propagation of the light, and wherein at least two or all lenses of the second array have radii of curvature that differ from one another or focal lengths that differ from one another.

13. The lighting device according to claim 12, wherein the lenses are spherical.

* * * * *